United States Patent [19]

Takeuchi et al.

[11] Patent Number: 5,039,235

[45] Date of Patent: Aug. 13, 1991

[54] PRINTER UTILIZING IMPROVED IMPACT DOT PRINT HEAD

[75] Inventors: Takashi Takeuchi; Akio Mitsuishi, both of Suwa, Japan

[73] Assignee: Seiko Epson Corporation, Japan

[21] Appl. No.: 423,761

[22] Filed: Oct. 17, 1989

[30] Foreign Application Priority Data

Oct. 18, 1988 [JP] Japan ..... 63-262292

[51] Int. Cl.[5] ..... B41J 2/285

[52] U.S. Cl. ..... 400/124; 101/93.05

[58] Field of Search ..... 400/124; 101/93.05

[56] References Cited

U.S. PATENT DOCUMENTS

| | | | |
|---|---|---|---|
| 4,218,148 | 8/1980 | Matschke | 400/124 |
| 4,382,701 | 5/1983 | Davenport | 400/124 |
| 4,472,072 | 10/1984 | Harada et al. | 400/124 |
| 4,572,681 | 2/1986 | Miyazawa et al. | 400/124 |
| 4,687,354 | 8/1987 | Tanaka | 400/124 |
| 4,767,227 | 8/1988 | Mitsuishi et al. | 400/124 |
| 4,802,776 | 2/1989 | Miyazawa et al. | 400/124 |
| 4,895,464 | 1/1990 | Rubinshtein | 400/124 |

FOREIGN PATENT DOCUMENTS

| | | | |
|---|---|---|---|
| 0199669 | 12/1982 | Japan | 101/93.05 |
| 0168580 | 10/1983 | Japan | 101/93.05 |
| 00222759 | 10/1986 | Japan | 400/167 |
| 0050155 | 3/1987 | Japan | 101/93.05 |

*Primary Examiner*—Edgar S. Burr
*Assistant Examiner*—John S. Hilten
*Attorney, Agent, or Firm*—W. Douglas Carothers, Jr.

[57] ABSTRACT

A printer utilizes an impact dot print head achieving higher drive acceleration and resultant velocity for driving a print wire without notable increase in the moment of inertia through the provision of magnetic influencing means on adjacent or opposite sides of the print wire lever fulcrum or rotation center. The length of the print wire actuating lever between the rotation center and the print wire connection on one side of the lever is longer than the length of the lever between the rotation center and the point of magnetic influence on the other side of the lever. Thus, angular moment for driving a print wire actuating lever can be increased without notable increase of the moment of inertia by employing a magnetic influencing means on opposite sides of the rotation center of the print wire actuating lever. Therefore, an increase in the speed of printing can be achieved in the employment of the disclosed magnetic influencing means without any accompanying problems due to increased inertial mass of the print wire operating mechanism.

40 Claims, 6 Drawing Sheets

PRINTER UTILIZING IMPROVED IMPACT DOT PRINT HEAD

BACKGROUND OF THE INVENTION

This invention relates generally to a printer utilizing an impact wire dot print head and more particularly to a structure to permit an enhancement in the speed of print wire operation without a notable increase in the movement of inertia.

The typical prior art impact dot print head in a matrix dot printer utilizes a magnetic influencing means relative to a pivotable operating lever which has one end fixed to an end of a print wire and its other end having a plunger operative in conjunction with the magnetic influencing means. Upon actuation of the magnetic influencing means, the lever is pivoted at high speed causing the forward dot print end of the print wire to contact an ink ribbon and paper relative to a platen. See, for example, U.S. Pat. No. 4,572,681.

In order to achieve an increase in driving velocity of the print wire, it is necessary to enlarge the size of the plunger so that the force for rotating the lever is made larger to achieve higher drive velocity. This enlargement of the plunger, however, prevents the attainment of higher velocity operation because the larger plunger will also increase the moment of inertia of the lever.

It is the object of this invention to provide an impact dot print head that achieves higher drive velocity on the print wire due to greater pivotable force applied to the print wire lever without a notable increase in the moment of inertia.

SUMMARY OF THE INVENTION

According to this invention, a printer or print apparatus utilizes an impact dot print head achieving higher drive acceleration and velocity for driving a print wire without notable increase through the moment of inertia in the provision of magnetic influencing means on adjacent or opposite sides of the print wire actuating lever fulcrum or rotation center and wherein the length of the print wire actuating lever between the rotation center and the print wire connection on one side of the lever is longer than the length of the lever between the rotation center and the point of magnetic influence on the other side of the lever. The magnetic influencing means comprises soft magnetic plunger members provided on opposite sides of the rotation center or axis of the lever with one plunger member being part of a first magnetic circuit and the other plunger member being part of a second magnetic circuit. Neither or either or both magnetic circuits may further include a permanent magnet. To enhance operation in the case where one of the magnetic circuits contain a permanent magnet and the other contains no permanent magnet, a current is supplied first to an electric coil wound on a core in the first magnetic circuit containing a permanent magnet and then second to an electric coil wound on a core in the second magnetic circuit containing no permanent magnet. This method improves the energy conversion efficiency so that the amount of input energy needed for operation is comparatively lower. Therefore, in a printer employing an impact dot print head of this invention, angular moment for driving a print wire lever can be increased without notable increase of the moment of inertia by employing a magnetic influencing means on opposite sides of the rotation center of the print wire lever. As a result, high speed printing can be achieved by increasing the striking acceleration and resultant velocity of the print wire. Moreover, the energy conversion efficiency with the utilization of dual magnetic circuits is improved by incorporating the following attributes:

1. Employing soft magnetic plunger members on opposite sides of the rotational axis or rotation center of the print wire lever; and 2. Including both soft magnetic plungers as part of a magnetic circuit neither of which include a permanent magnet; or 3. Including one of the soft magnetic plunger members as a part of a magnetic circuit which includes a permanent magnet and the other soft magnetic plunger member as a part of a magnetic circuit which does not include a permanent magnet; or 4. Including both soft magnetic plungers as part of a magnetic circuit both of which include a permanent magnet; and/or 5. Applying a current to the coils at different times, i.e., in asynchronous phase relation, e.g., first application to an electric coil in a magnetic circuit which includes a permanent magnet and then, secondly, application to an electric coil in a magnetic circuit which does not include a permanent magnet, with the second mentioned application being initiated during the period of the first mentioned application.

Other objects and attainments together with a fuller understanding of the invention will become apparent and appreciated by referring to the following description and claims taken in conjunction with the accompanying drawings.

BRIEF DESCRIPTION OF THE DRAWINGS

FIG. 6(*c*) is a graphic illustration of the displacement of a print wire of an impact dot print head in accordance with the several embodiments of this invention;

FIG. 7(*c*) is a graphic illustration of the displacement of a print wire of an impact dot print head in accordance with the third and fourth embodiments of this invention.

DESCRIPTION OF THE PREFERRED EMBODIMENTS

Figure 1:
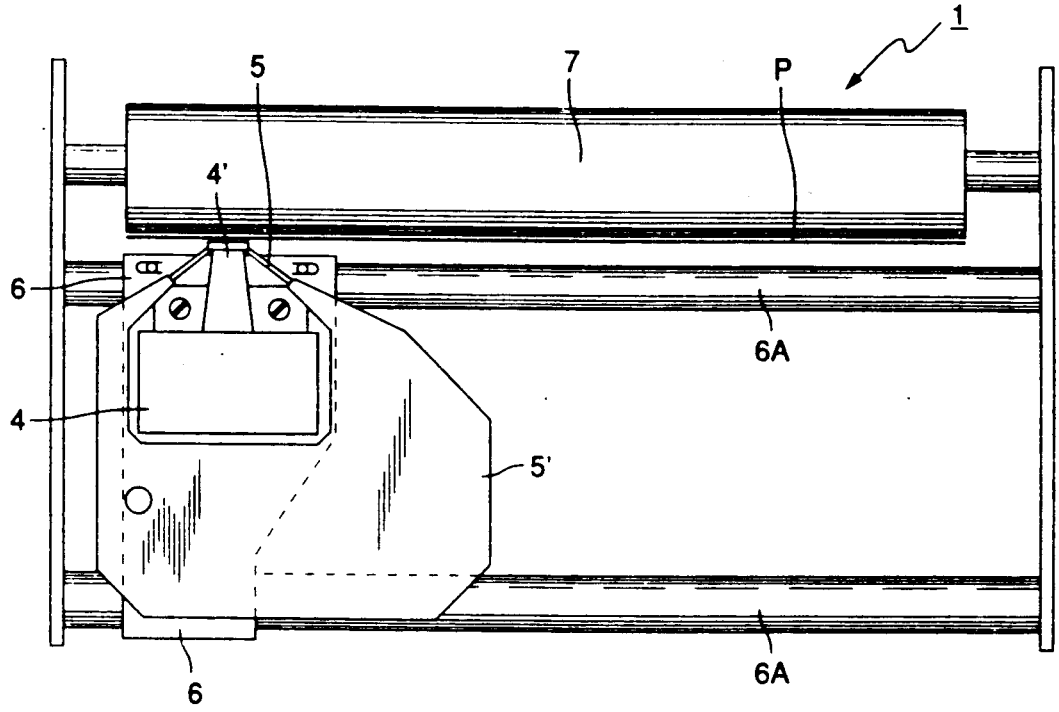
FIG. 1 is a plan view of an impact dot matrix printer utilizing an impact dot print head according to this invention.

Reference is now made to FIG. 1 wherein there is shown a print apparatus a comprising a matrix impact printer 1 which comprises an impact dot print head 4 mounted on carriage 6. Carriage 6 is moveably mounted on horizontal rods or bars 6A and 6B for lateral movement of head 4 relative to platen 7. Carriage 6 also includes ribbon cartridge 5' having ribbon 5 for passage over the nose 4' of head 4. Upon activation of one or more dot wires in head 4, a dot matrix imprint is made on paper P interposed between ribbon 5 and platen 7 as carriage 6 is moved laterally along bars 6A and 6B.

Figure 2:
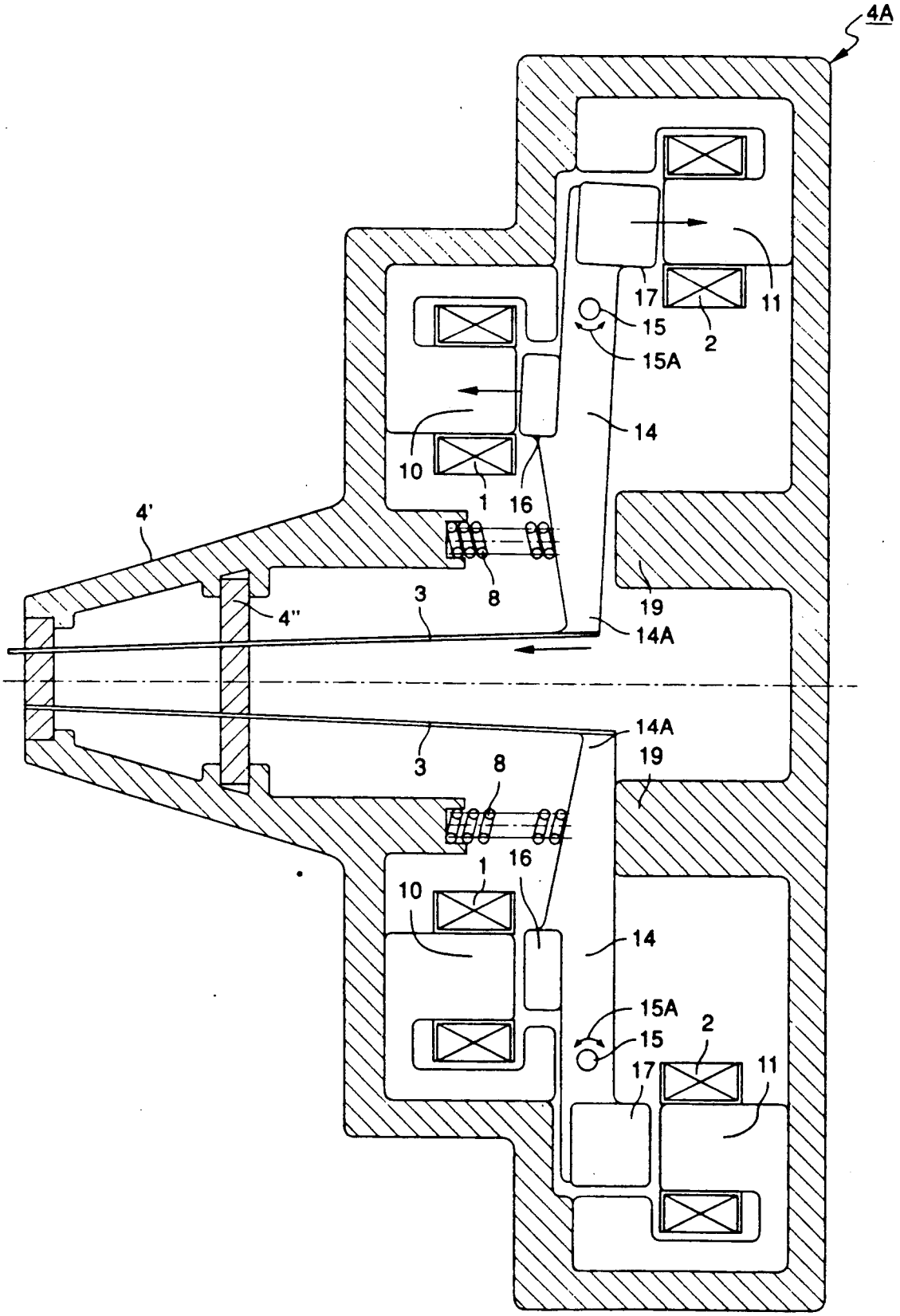
FIG. 2 is a cross sectional view of an impact dot print head in accordance with a first embodiment of this invention.

FIG. 2 illustrates a first embodiment of this invention wherein impact dot print head 4A comprises a plurality of levers 14 mounted for rotation about axis 15, two such levers being illustrated in the figure. Levers 14 are mounted on rotational axis 15 via a bearing (not shown) in order that lever 14 will rotate as indicated by arrow 15A. The forward end of levers 14 are each secured to print wire 3 which are moveably supported in guide 4'' in head nose 4'. Plungers 16 and 17 are mounted on either side or opposite sides of axis 15 of each lever 14 in alignment with their respective cores 10 and 11. Plungers 16 and 17, as well as plungers in later described embodiments, comprise soft magnetic material, i.e., a high magnetic permeable material such as pure iron, silicon steel, etc. Electric coils 1 and 2 are respectively mounted on cores 10 and 11. Thus, magnetic influencing means comprises two magnetic circuits which are employed relative to each lever 14 at opposite sides of rotation center 15, one circuit comprising core 10 and its yoke, plunger 16 and coil 1 and the other circuit comprising core 11 and its yoke, plunger 17 and coil 2.

Lever 14 illustrated in the upper portion of FIG. 2 is shown in its activated position with its dot wire 3 extended from nose 4'. Lever 14 in the lower portion of FIG. 2 is shown in its deactivated, rest or standby position wherein print wire 3 is retracted in nose 4'. In its standby position, lever 14 is held against abutment 19 by means of compression spring 8.

In operation, plungers 16 and 17 of lever 14 are attracted respectively to cores 10 and 11 under the influence of the magnetic flux generated by coils 1 and 2. As a result, lever 14 is rotated so that its connected dot wire 3 extends to a printing position illustrated in the upper portion of FIG. 2 with the dot end of print wire 3 striking paper P and platen 7 before plungers 16 and 17 contact their respective cores 10 and 11. The magnetic attraction supplied by the magnetic circuit of coils 1 and 2 is sufficient to overcome the compression force of spring 8 and move lever 14 away from abutment 19. Release of lever 14, to return the lever to its standby position against abutment 19 as illustrated in the lower portion of FIG. 2, is accomplished by termination of current flow in coils 1 and 2 and the compression force of spring 8.

Figure 6A:
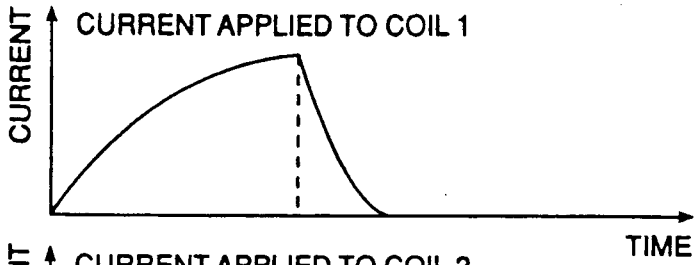
FIGS. 6(*a*) and 6(*b*) are graphic illustrations depicting the current operation versus time for concurrent operation of the first and second electric circuit coils with respect to the various embodiments of this invention.
Figure 6B:
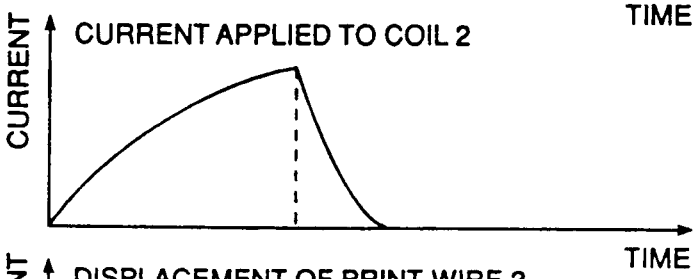
Figure 6C:
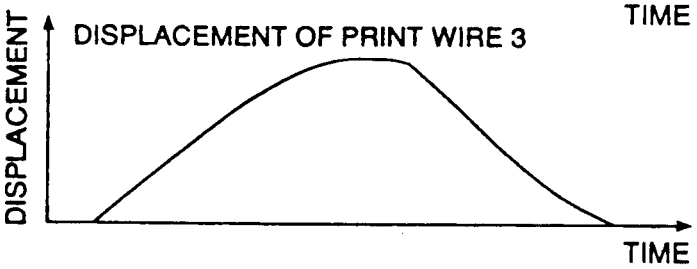

Besides the employment of two plungers for each lever 14, the distance between rotational axis 15 and lever end 14A secured to print wire 3 on one side of lever 14 is longer than the distance between rotational axis 15 and plunger 17 secured on the other side of lever 14. This results in greater displacement of lever end 14A relative to smaller displacement at plunger 17 upon rotational movement of lever 14 to its activated position. Since there are two plungers 16 and 17 for each lever affixed on opposite sides of rotational axis 15, angular movement at lever end 14A will be comparatively greater and, in combination with increased striking acceleration of print wire 3, results in higher printing speed. This is illustrated in FIG. 6 wherein the current is applied simultaneously to electric coils 1 and 2 thereby simultaneously attracting both plungers 16 and 17 to rotate lever 14 and bring about displacement of print wire 3 to its extended printing position.

Figure 3:
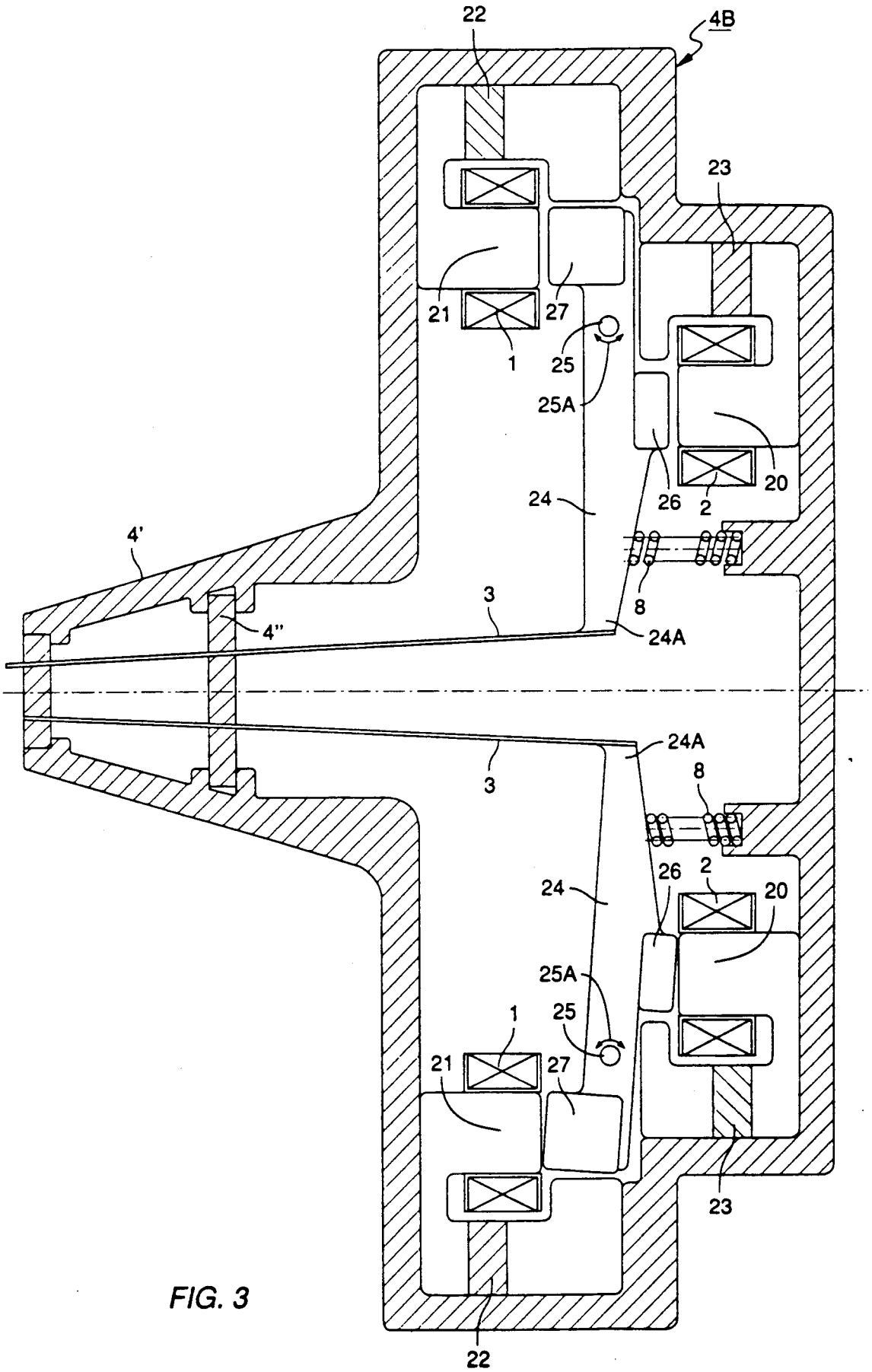
FIG. 3 is a cross sectional view of an impact dot print head in accordance with a second embodiment of this invention.

Reference is now made to FIG. 3 wherein there is shown a second embodiment of this invention. Head 4B is similar in fundamental components to head 4A in FIG. 2 except head 4B in addition employs permanent magnets 22 and 23 and utilizes the compression force of spring 8 to place print wire 3 in its activated position. Head 4B comprises a plurality of levers 24 mounted for rotation about axis 25 with two such levers illustrated in FIG. 3. Levers 24 will rotate about axis 25 as indicated by arrows 25A. Plungers 26 and 27 are secured to lever 24 on opposite sides of axis 25 and on opposite edges of each lever 24 in alignment with cores 20 and 21, respectively. Electric coils 1 and 2 are respectively mounted on cores 21 and 20. In connection with each core 20 and 21, a respective permanent magnet 22 and 23 is included in the yoke of each core, as illustrated in FIG. 3.

As illustrated in the lower portion of FIG. 3, plunger 26 is attracted toward core 20 by magnetic flux generated by permanent magnet 23 and plunger 27 is attracted toward core 21 by magnetic flux generated by permanent magnet 22 holding print wire 3 in its retracted position in nose 4'. Lever 24 is held against the compressive force of spring 8 with plungers 26 and 27 respectively resting on cores 20 and 21 functioning as stops.

Lever 24 in the upper portion of FIG. 3 is shown in its activated position with its print wire 3 extended from nose 4'. In operation, when a current is passed through coils 1 and 2, a magnetic force is produced that is opposite in field to the magnetic field produced by permanent magnets 22 and 23. As a result, the magnetic field of magnets 22 and 23 are effectively cancelled thereby releasing the compressive force of spring 8 which rotates lever 24 to extend its connected print wire 3 out of nose 4' to engage the dot end of print wire 3 on paper, P against platen 7. Also, the distance between axis 25 and end 24A on one side of lever 24 is longer than the distance between axis 25 and plunger 27 on the other side of lever 24. This results in greater displacement of lever end 24A relative to the end of plunger 27 and lever 24 upon rotational movement of lever 24 to its activated position.

With reference again to FIG. 6, by applying a current to both electric coils 1 and 2, the magnetic flux of permanent magnets 22 and 23 is cancelled so that lever 24 is rotatable about axis 25 due to the compressive force of spring 8. Since plungers 26 and 27 for each lever 24 are affixed on opposite sides of rotational axis 25, the angular movement on lever 24 is greater than that of the prior art wherein a single plunger is provided at only one end or side of the print wire actuating lever. Further, the spring force of compression spring 8 can be enlarged proportional to the increase in angular moment achieved in the use of two magnetic influencing means. As a result, an increase in displacement acceleration of print wire is achieved resulting in higher printing speed without a notable increase in moment of inertia since there has been no significant increase in mass relative to rotational inertia of the print wire actuating lever.

Figure 4:
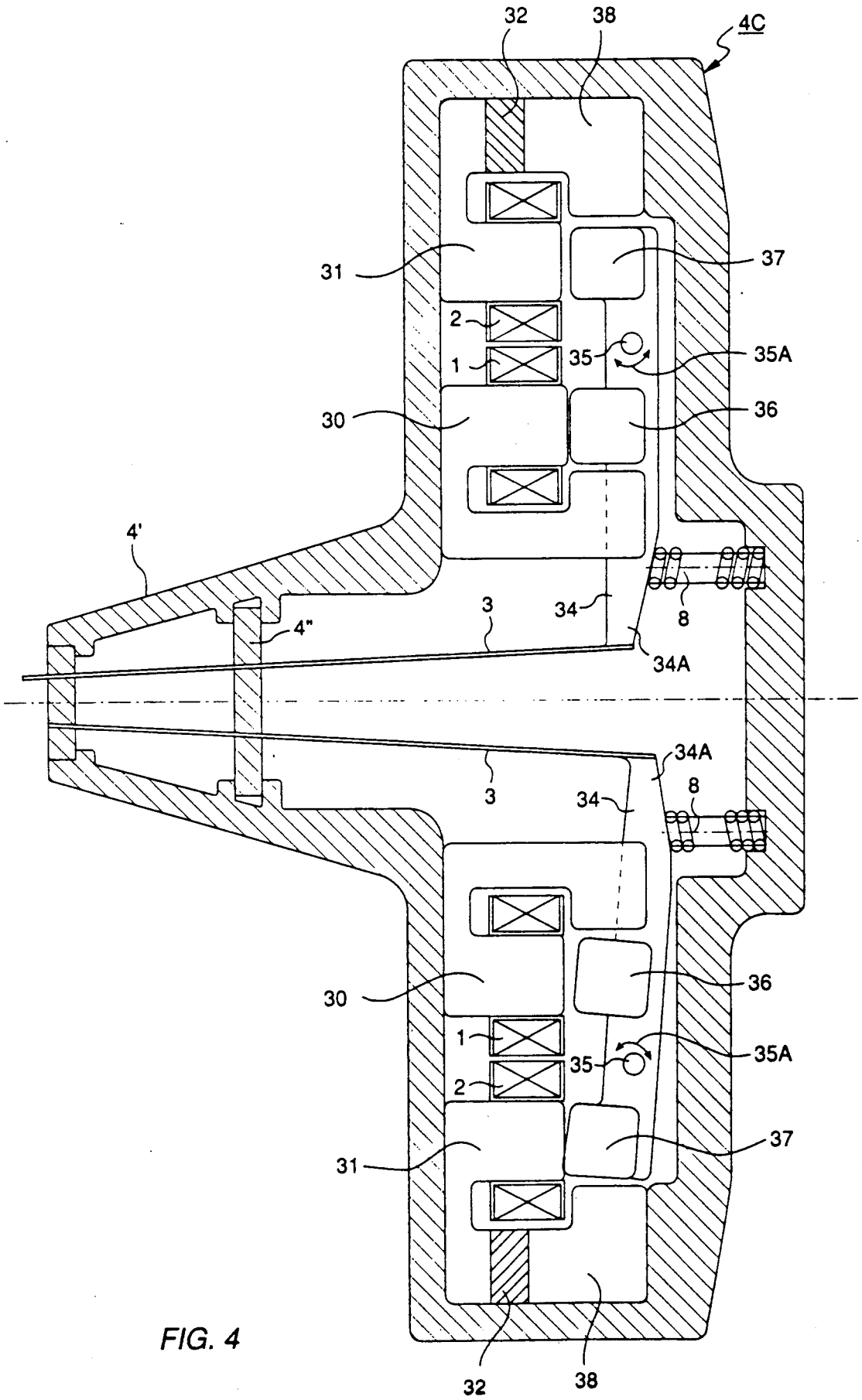
FIG. 4 is a cross sectional view of an impact dot print head in accordance with a third embodiment of this invention.

Reference is now made to FIG. 4 wherein there is shown a third embodiment of this invention. Head 4C is similar in fundamental components to head 4B in FIG. 3 except that the arrangement and location of magnetic circuits is different as well as the employment of permanent magnets. Head 4C comprises a plurality of levers 34 rotatable about axis 35. Levers 34 will rotate about axis 35 as indicated by arrows 35A. Plungers 36 and 37 are both secured on the same front edge of lever 34 but on opposite sides of its rotational axis 35 and are in alignment with respective cores 30 and 31. Electric coils 1 and 2 are respectively mounted on cores 30 and 31. In connection with core 31, a permanent magnet 32 is included in its yoke 38, as illustrated in FIG. 4. Thus, a magnetic circuit, comprising core 30, coil 1 and plunger 36 without a permanent magnet, is located at the inner space or region of print head 4C while a magnetic circuit, comprising core 31, permanent magnet 32, yoke 38 and plunger 37, is located at the peripheral side of print head 4C.

In the deactivated or standby position for lever 34, illustrated in the lower portion of FIG. 4, plunger 37 is attracted toward core 31 by the magnetic flux generated by permanent magnet 32 thereby holding print wire 3 secured at the inner end 34A of lever 34, in its retracted position with end 34A held against the compression force of spring 8 and plunger 37 resting against core 31 and thereby functioning as a stop for lever 34. Lever 34 is brought into its activated position with its print print wire 3, extended from nose 4', as illustrated in the upper portion of FIG. 4, by application of current to electric coils 1 and 2. As a result, the magnetic flux of permanent magnet 32 is cancelled by an opposite magnetic filed generated by coil 2 while concurrently plunger 36 is attracted to core 30 due to the magnetic field developed by electric coil 1. Also, lever 34 is rotated about axis 35 by the combination of force of both the magnetic influencing means between core 30 and plunger 36 and compression spring 8, which are both positioned on the same side of lever 34 relative to rotational axis 35.

Again, the distance between rotational axis 35 and end 34A on one side of lever 34 is longer than the distance between rotational axis 35 and plunger 37 on the other side of lever 34. This results in greater displacement of lever end 34A relative to the plunger 37 end of lever 34 upon rotational movement of lever 34 to its activated position. Since plungers 36 and 37 on each lever 34 are affixed on opposite sides of rotational axis 35, the angular moment on lever 34 is greater than that of the prior art wherein only a single plunger is provided at one end or side of the lever without the combined assistance of spring 8. Also, in this embodiment, since a magnetic circuit including permanent magnet 32 is located on the peripheral side of head 4C, the cross sectional area of the magnet may be enlarged so that plunger 37 will be attracted toward core 31 with greater force. As a result, the spring constant for spring 8 may be raised so that lever 34 can be rotated at a high velocity via the combined force of plunger 36 and spring 8.

Figure 5:
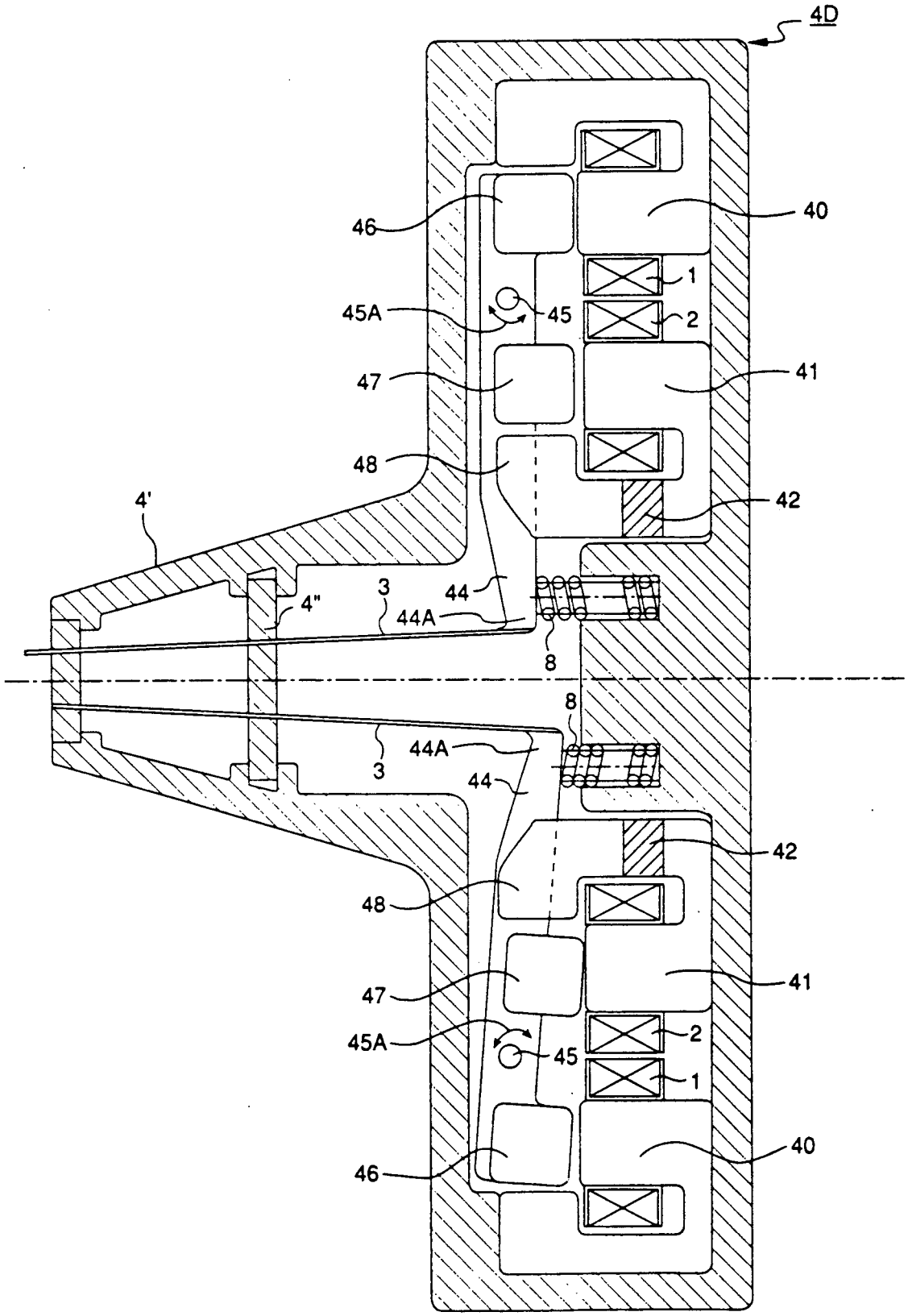
FIG. 5 is a cross sectional view of an impact dot print head in accordance with a fourth embodiment of this invention.

Reference is now made to FIG. 5 wherein there is shown a fourth embodiment of this invention. Head 4D is similar in fundamental components relative to head 4C in FIG. 4 except that the arrangement and location of magnetic circuits and the location of the permanent magnets are different. Head 4D comprises a plurality of levers 44 rotatable about axis 45 as indicated by arrows 45A. Plungers 46 and 47 are both secured on the same back edge of lever 44 but are on opposite sides of its rotational axis 45 and are in aligned position with respective cores 40 and 41. Electric coils 1 and 2 are respectively mounted on cores 40 and 41. In connection with core 41, permanent magnet 42 is included in its yoke 48, as shown in FIG. 5.

In this connection, a magnetic circuit, comprising the combination of plunger 46, coil 1, and core 40 without a permanent magnet, is located at peripheral side of print head 4D while a magnetic circuit, comprising the combination of core 41, permanent magnet 42, yoke 48 and plunger 47, is located at the inner space or region of print head 4D.

In the deactivated or standby position for lever 44, illustrated in the lower portion of FIG. 5, plunger 47 is attracted toward core 41 by the magnetic flux generated by permanent magnet 42 thereby holding print wire 3, secured at the inner end 44A of lever 44, in its retracted position with end 44A held against the compression force of spring 8 and with plunger 47 resting against core 41 and thereby functioning as a stop for lever 44. Lever 44 is brought into its activated position with its print wire 3 extended from nose 4', as illustrated in the upper portion of FIG. 5, by the application of current to electric coils 1 and 2. As a result, the magnetic flux of permanent magnet 42 is cancelled by an opposite magnetic filed generated by coil 2 while concurrently plunger 46 is attracted to core 40 due to the magnetic field developed by coil 1. Also, lever 44 is rotated about axis 45 by the combination of force of both the magnetic influencing means between core 40 and plunger 46 at one end of lever 44 and compression spring 8 adjacent the other end 44A of lever 44 relative to rotational axis 45. Again, the distance between axis 45 and end 44A on one side of lever 44 is longer than the distance between axis 45 and plunger 46 on the other side of lever. This results in greater displacement of lever end 44A relative to the plunger 46 end of lever 44 upon rotational movement of lever 44 to its activated position. Since plungers 46 and 47 are affixed on opposite sides of rotation axis 45 on lever 44, the angular movement on lever 44 is greater than that in the prior art wherein only single plunger is provided at one end or side of the lever without the combined assistance of spring 8. Also, in this embodiment, since the magnetic circuit utilizing permanent magnet 42 is located in the inner space or region of head 4D, compared to the peripheral side in the embodiment of FIG. 4. As a result, the inner space of print head 4D is effectively utilized thereby permitting the design of a smaller print head body.

Figure 7A:
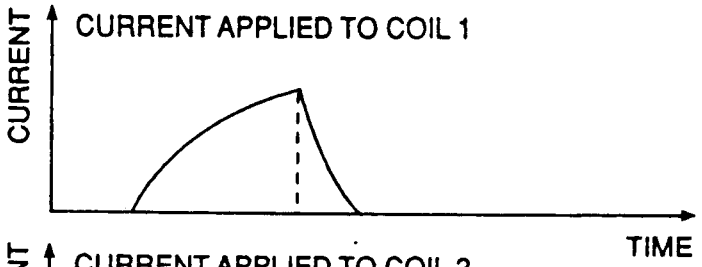
FIGS. 7(*a*) and 7(*b*) are graphic illustrations depicting the current operation versus time for sequential operation of the first and second electric circuit coils with respect to the third and fourth embodiments of this invention.
Figure 7B:
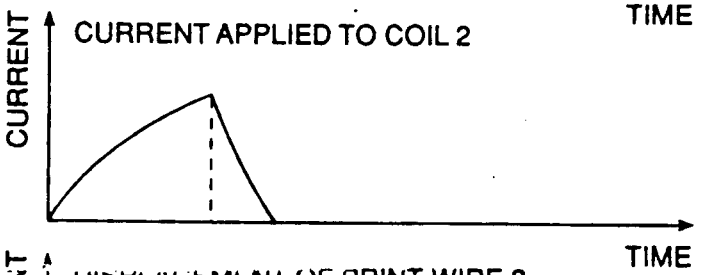
Figure 7C:
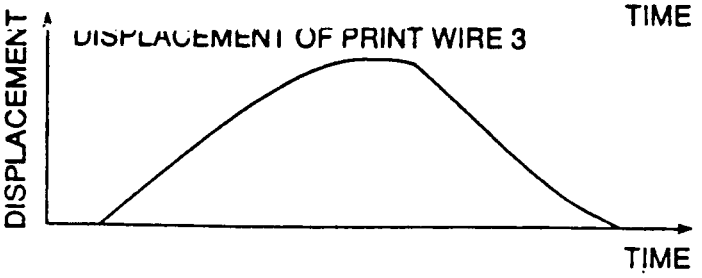

In connection with all the forgoing embodiments, the current is applied concurrently to electric coils 1 and 2, as per FIGS. 6(*a*) and 6(*b*), to provide a displacement function as exemplified in FIG. 6(*c*). However, as illustrated in FIG. 7, it is also possible that the current not be applied concurrently to coils 1 and 2 relative to embodiments shown in FIGS. 4 and 5 but rather current first applied to an electric coil of a magnetic circuit that includes a permanent magnet and then to an electric coil of a magnetic circuit that does not include a permanent magnet. In this connection, plungers 37 and 47 are respectively employed as a part of a magnetic circuits that includes permanent magnets 32 and 42. As indicated previously, magnetic circuits, respectively comprise plungers 37 and 47, cores 31 and 41, coils 2, permanent magnets 32 and 42 and yokes 38 and 48. In the deactivated or standby mode, plungers 37 and 47 are attracted toward cores 31 and 41, respectively. Also, in standby mode, the air gap of the magnetic circuits is minimized while the inductance of electric coils 2 are maximized. During the course of activation of print wire 3 via rotational movement of its corresponding lever 34 and 44, plungers 37 and 47 are increasingly separated from their respective cores 31 and 41 so that the air gap of the above mentioned magnetic circuits is continuously increased and the inductance of electric coil 2 is continually decreased until the dot end of print wire 3 strikes the recording medium or paper, P. Therefore, the energy conversion efficiency of coil 2 is maximum when print wire 3 commences its movement in the activation period and decreases monotonically during the period until the dot end of print wire 3 strikes the recording medium.

On the other hand, plungers 36 and 46 are respectively employed as a part of a magnetic circuit that includes cores 30 and 40 and their coils 1 but no permanent magnets. In the deactivated or standby mode, plungers 36 and 46 are in their further most distant positions from their respective cores 30 and 40 and, as a result, the air gap of the magnetic circuit is maximized while the inductance of coil 1 is minimized. During the course of activation of print wire 3 via rotational movement of its corresponding lever 34 and 44, plungers 36 and 46 are increasingly brought closer to their respective cores 30 and 40 so that the air gap of the magnetic circuit is continuously decreased and the inductance of electric coil 1 is continuously increased until the dot end of print wire 3 strikes the recording medium. Therefore, the energy conversion efficiency of electric coil 1 is minimum when print wire 3 commences its movement in the activation cycle and increases monotonically during the period until the dot end of print wire 3 strikes the recording medium.

In connection with both sets of magnetic circuits in these third and fourth embodiments, the current is applied initially to electric coil 2 of the magnetic circuit containing a permanent magnet and, thereafter, part way into the activation period of current application to electric coil 2, current is applied to electric coil 1 of the magnetic circuit containing no permanent magnet, as illustrated in FIG. 7(*a*) and 7(*b*). In this manner, the energy conversion efficiency of electric coils 1 and 2 is maximized, respectively, at the beginning and the end of the activation period thereby taking optimum advantage of energy conversion efficiency during the activation period of this dual magnetic circuit system. As a result, less energy is utilized in the sequential operation of the respective magnetic circuits per FIG. 7. Therefore, under substantially identical physical and operational conditions, lower input energy is required per the sequential operation scheme of FIG. 7 compared to the input energy required in the case of concurrent operation scheme of FIG. 6. Examples of such physical and operational conditions are the coil diameter or number of windings of electric coils 1 and 2, applied voltage level to coils 1 and 2 and the time period of current application to electric coil 1 and 2, permanent magnet properties etc.

While the savings of energy input is realized relative to the sequential operation of FIG. 7, an alternative approach is now also possible in that the energy input may be increased in the third and fourth embodiments, for example, to the original energy level relative to the concurrent operation of FIG. 6, thereby further increasing the striking acceleration and resultant velocity of the print wire. In other words, for a given input energy, the printing speed of the print wires in FIGS. 4 and 5 may be further enhanced employing the sequential operation of FIG. 7 as compared to the concurrent operation of FIG. 6.

Relative to the FIG. 7 sequential operation of electric coils 1 and 2, it should be realized that savings in input energy is achieved, in part, due to prior initiation of the cancellation of the magnetic flux of permanent magnets 32 or 42 via initial current flow to electric coil 2 before the introduction of current flow to electric coil 1, the latter of which provides a portion of the driving force to rotate the print wire actuating lever into its activated position.

In summary, a printer apparatus shown in FIG. 1 employing the impact dot print head of this invention, the angular moment of the print wire lever can be effectively increased without notable increase of the moment of inertia by employing magnetic influencing means, which include dual magnetic circuits that may or may not include a permanent magnet, such means being provided on opposite sides of the rotation center of the print wire lever.

While the invention has been described in conjunction with several specific embodiments, it is evident to those skilled in the art that many further alternatives, modifications and variations will be apparent in light of the forgoing description. Thus, the invention described herein is intended to embrace all such alternatives, modifications, applications and variations as fall within the spirit and scope of the appended claims.

What is claimed is:

1. A printer comprising an impact dot print head, said head comprising a plurality of print wires each selectively operable by dual magnetic influencing means via a rotatably mounted lever connected at one end to said print wire, said dual magnetic influencing means provided respectively on opposite sides of both a plane passing through said lever rotational center and perpendicular to the longitudinal extent of the lever and a plane passing through said lever rotational center and parallel to the longitudinal extent of said lever and together operative to accelerate forward said lever one end, the lever distance between said rotation center and said one end being longer than the lever distance between said rotation center and the point of influence of said magnetic influencing means provided on said lever at the opposite side of said center of rotation relative to said one end.

2. The printer of claim 1 wherein said magnetic influencing means comprises a magnetic circuit on said opposite sides of said rotation center, a pair of soft magnetic members on said lever to function as plungers and each functioning as a part of one of said circuits.

3. The printer of claim 1 wherein said magnetic influencing means comprises a magnetic circuit on said opposite sides of said rotation center, at least one of said circuits including a permanent magnet.

4. The printer of claim 3 wherein each of said magnetic circuits includes an electric coil wound on a yoke, at least one of said yokes including a permanent magnet.

5. The printer of claim 3 wherein each of said magnetic circuits includes an electric coil wound on a yoke, said yokes including a permanent magnet.

6. A printer comprising an impact dot print head, said head comprising a plurality of print wires each selectively operable by dual magnetic influencing means via a rotatably mounted lever connected at one end to said print wire, said dual magnetic influencing means provided respectively on opposite sides of both a plane passing through said lever rotational center and perpendicular to the longitudinal extent of the lever and a plane passing through said lever rotational center and parallel to the longitudinal extent of said lever and together operative to accelerate forward said one end of a corresponding lever during an activation period thereof to provide higher printing speed without notable increase in the moment of inertia due to the rotation of said lever.

7. The printer of claim 6 wherein the lever distance between said rotation center and said one end being longer than the lever distance between said rotation center and the point of influence of said magnetic influencing means provided on said lever at the opposite side of said center of rotation relative to said one end.

8. A printer comprising an impact dot print head, said head comprising a plurality of print wires each selectively operable by magnetic influencing means via a rotatably mounted lever connected at one end to said print wire, said magnetic influencing means for each lever comprising a pair of magnetic circuits each having a plunger on said lever and an aligned electric coil mounted on a core adjacent said plunger with one circuit arranged on one side of the rotational center of said lever and the other circuit arranged on the other side of the rotational center of said lever in a manner that said magnetic circuits are positioned respectively on opposite sides of a plane passing through said lever rotational center and perpendicular to the longitudinal extent of said lever, one of said circuits including a permanent magnet, said lever held in its standby position by said one circuit permanent magnet and moved to its forward activated position by the operational combination of said circuits comprising operation of said one circuit to cancel the magnetic flux filed of said permanent magnet and the operation of said other circuit to rotate said lever at high speed.

9. The printer of claim 8 including additional means to urge said lever into its actuated position upon operation of said magnetic circuits.

10. The printer of claim 9 wherein said additional means comprises a spring.

11. The printer of claim 8 wherein said circuit coils are operated concurrently.

12. The printer of claim 8 wherein said circuit coils are operated in sequence with the operation of said one circuit initiated prior to the operation of said other circuit.

13. A printer comprising an impact dot print head, said head comprising a plurality of print wires each selectively operable by magnetic influencing means via a rotatably mounted lever connected at one end to said print wire, said magnetic influencing means for each lever comprising a pair of magnetic circuits each having a plunger on said lever and an aligned electric coil mounted on a core adjacent said plunger with one circuit arranged on one side of the rotational center of said lever and the other circuit arranged on the other side of the rotational center of said lever in a manner that said magnetic circuits are positioned respectively on opposite sides of a plane passing through said lever rotational center and perpendicular to the longitudinal extent of said lever, both of said circuits including a permanent magnet, said lever held in its standby position by said permanent magnets, means to urge said lever into its forward actuated position by the operational combination of said circuits comprising operation of said magnetic circuits, the operation of said magnetic circuits cancelling the magnetic flux of said permanent magnets to permit said urging means to rotate said lever at high speed to its forward actuated position.

14. The printer of claim 11 wherein said urging mean comprises a spring.

15. A method of operating an impact dot printer having a dot print head comprising a plurality of dot print head wires and a plurality of print wire operating means with magnetic influencing means to selectively operate said wires relative to their activated and standby positions and comprising the steps of:

providing two magnetic circuits comprising said magnetic influencing means for each print wire operating means with each circuit having an electric coil, one of said circuits including a permanent magnet and the other of said circuits not including a permanent magnet, and applying a current sequentially to said two magnetic circuit coils so that the operational combination of said circuits accelerate the forward movement of the lever in to place a corresponding print wire in its activated position.

16. The method of operating an impact dot printer of claim 15 including the steps of:

initially applying current to the electric coil of the magnetic circuit which includes a permanent magnet, thereafter applying current to the electric coil of the magnetic circuit which does not include a permanent magnet in the period of current application to the electric coil of said permanent magnet magnetic circuit.

17. In an impact dot print head, said head comprising a plurality of print wires each selectively operable by magnetic influencing means via a rotatably mounted lever connected at one end to said print wire, said magnetic influencing means provided on opposite sides of both a plane passing through said lever rotational center and perpendicular to the longitudinal extent of the lever and a plane passing through said lever rotational center and parallel to the longitudinal extent of said lever and together operable to accelerate forward said one end during an activation period thereof to provide higher printing speed without notable increase in the moment of inertia due to the rotation of said lever.

18. The impact dot print head of claim 17 wherein the lever distance between said rotation center and said one end being longer than the lever distance between said rotation center and the point of influence of said magnetic influencing means provided on said lever at the opposite side of said center of rotation relative to said one end.

19. In an impact dot print head, said head comprising a plurality of print wires each selectively operable by magnetic influencing means via a rotatably mounted lever connected at one end to said print wire, said magnetic influencing means for each lever comprising a pair of magnetic circuits each having a plunger on said lever and an aligned electric coil mounted on a core adjacent said plunger with one circuit arranged on one side of the rotational center of said lever and the other circuit arranged on the other side of the rotational center of said lever in a manner that said magnetic circuits are positioned respectively on opposite sides of a plane passing through said lever rotational center and perpendicular to the longitudinal extent of said lever, one of said circuits including a permanent magnet, said lever held in its standby position by said one circuit permanent magnet and moved to its forward activated position by the operational combination of said circuits comprising operation of said one circuit to cancel the magnetic flux of said permanent magnet and the operation of said other circuit to rotate said lever at high speed.

20. In the impact dot print head of claim 19 including additional means to urge said lever into its actuated position upon operation of said magnetic circuits.

21. In the impact dot print head of claim 20 wherein said additional means comprises a spring.

22. In the impact dot print head of claim 19 wherein said circuit coils are operated concurrently.

23. In the impact dot print head of claim 19 wherein said circuit coils are operated in sequence with the operation of said one circuit initiated prior to the operation of said other circuit.

24. In an impact dot print head, said head comprising a plurality of print wires each selectively operable by magnetic influencing means via a rotatably mounted lever connected at one end to said print wire, said magnetic influencing means for each lever comprising a pair of magnetic circuits each having a plunger on said lever and an aligned electric coil mounted on a core adjacent said plunger with one circuit arranged on one side of the rotational center of said lever and the other circuit arranged on the other side of the rotational center of said lever in a manner that said magnetic circuits are positioned respectively on opposite sides of a plane passing through said lever rotational center and perpendicular to the longitudinal extent of said lever, both of said circuits including a permanent magnet, said lever held in its standby position by said permanent magnets, means to urge said lever into its forward actuated position by the operational combination of said circuits comprising operation of said magnetic circuits, the operation of said magnetic circuits cancelling the magnetic flux of said permanent magnets to permit said urging means to rotate said lever at high speed to its forward actuated position.

25. In the impact dot print head of claim 24 wherein said urging mean comprises a spring.

26. The printer of claim 1 wherein said dual magnetic influencing means are operated concurrently to assist in said lever rotational movement.

27. The printer of claim 1 wherein said dual magnetic influencing means are operated sequentially to assist in said lever rotational movement.

28. The printer of claim 3 wherein said magnetic circuits are operated sequentially to assist in said lever rotational movement, said magnetic circuit including said permanent magnet circuit being operated prior to the operation of the other of said circuits.

29. The printer of claim 6 wherein said dual magnetic influencing means are operated concurrently to assist in said lever rotational movement.

30. The printer of claim 6 wherein said dual magnetic influencing means are operated sequentially to assist in said lever rotational movement.

31. The printer of claim 17 wherein said dual magnetic influencing means are operated concurrently to assist in said lever rotational movement.

32. The printer of claim 17 wherein said dual magnetic influencing means are operated sequentially to assist in said lever rotational movement.

33. A printer comprising an impact dot print head, said head comprising a plurality of print wires each selectively operable by dual magnetic influencing means via a rotatably mounted lever connected at one end to said print wire, said dual magnetic influencing means provided respectively on opposite sides of both a plane passing through said lever rotational center and perpendicular to the longitudinal extent of the lever and a plane passing through said lever rotational center and parallel to the longitudinal extent of said lever and together to accelerate said lever one end to its forward activated position, at least one of said dual magnetic influencing means for each of said levers including a permanent magnet, said levers held in their standby position by said permanent magnet in said at least one magnetic influencing means, means to urge selected of said levers into their forward actuated position upon the combined operation of its dual magnetic influencing means, the operation of said dual magnetic influencing means cancelling the magnetic flux of said permanent magnet and assisting said urging means to rotate said lever at high speed to its forward actuated position.

34. The printer of claim 33 wherein each of said dual magnetic influencing means for each corresponding lever includes a permanent magnet.

35. The printer of claim 33 wherein said dual magnetic influencing means for each corresponding lever are concurrently operated to provide said actuated position.

36. The printer of claim 33 wherein said at least one dual magnetic influencing means for each corresponding lever is operated in advance of the other said dual magnetic influencing means for the same corresponding lever to provide said actuated position.

37. An impact dot print head comprising a plurality of print wires each selectively operable by dual magnetic influencing means via a rotatably mounted lever connected at one end to said print wire, said dual magnetic influencing means provided respectively on opposite sides of both a plane passing through said lever rotational center and perpendicular to the longitudinal extent of the lever and a plane passing through said lever rotational center and parallel to the longitudinal extent of said lever and together operative to accelerate said lever one end to its forward activated position, at least one of said dual magnetic influencing means for each of said levers including a permanent magnet, said levers held in their standby position by said permanent magnet in said at least one magnetic influencing means, means to urge selected of said levers into their forward actuated position upon the combined operation of its dual magnetic influencing means, the operation of said dual magnetic influencing means cancelling the magnetic flux of said permanent magnet and assisting said urging means to rotate said lever at high speed to its forward actuated position.

38. The impact dot print head of claim 37 wherein each of said dual magnetic influencing means for each corresponding lever includes a permanent magnet.

39. The impact dot print head of claim 37 wherein said dual magnetic influencing means for each corresponding lever are concurrently operated to provide said actuated position.

40. The impact dot print head of claim 37 wherein said at least one dual magnetic influencing means for each corresponding lever is operated in advance of the other said dual magnetic influencing means for the same corresponding lever to provide said actuated position.

* * * * *